US005337945A

United States Patent [19]

Fehrle et al.

[11] Patent Number: 5,337,945

[45] Date of Patent: Aug. 16, 1994

[54] DEVICE FOR DRIVING-IN STITCHES

[75] Inventors: Siegfried Fehrle; Wilfried Kabatnik, both of Leinfelden-Echterdingen; Manfred Buck, Nürtingen; Klaus Dietz, Filderstadt; Martin Hoelzel; Klaus Kleyer, both of Stuttgart; Wolfgang Schmid, Filderstadt; Karl Wanner, Leinfelden-Echterdingen, all of Fed. Rep. of Germany

[73] Assignee: Robert Bosch GmbH, Stuttgart, Fed. Rep. of Germany

[21] Appl. No.: 976,173

[22] Filed: Nov. 13, 1992

Related U.S. Application Data

[63] Continuation of Ser. No. 819,095, Jan. 9, 1992, abandoned.

[30] Foreign Application Priority Data

Mar. 22, 1991 [DE] Fed. Rep. of Germany ..... 4109362

[51] Int. Cl.[5] ..... B25C 7/00

[52] U.S. Cl. ..... 227/109; 227/127

[58] Field of Search ..... 227/109, 119, 127, 120

[56] References Cited

U.S. PATENT DOCUMENTS

| | | | |
|---|---|---|---|
| 3,058,114 | 10/1962 | Haubold . | |
| 3,140,492 | 7/1964 | Blade . | |
| 3,510,043 | 5/1970 | Larson . | |
| 3,633,811 | 1/1972 | Ploen | 227/109 |
| 3,905,535 | 9/1975 | Novak et al. . | |
| 3,958,738 | 5/1976 | Tremblay | 227/109 |
| 4,211,351 | 7/1980 | Monacelli . | |
| 4,304,349 | 12/1981 | Novak et al. | 227/109 |
| 4,556,161 | 12/1985 | Oide | 227/109 X |
| 4,693,407 | 9/1987 | Buck et al. | 227/109 |
| 4,732,309 | 3/1988 | Judge | 227/109 |
| 4,749,115 | 6/1988 | Fehrs | 227/109 |

*Primary Examiner*—Rinaldi I. Rada
*Attorney, Agent, or Firm*—Michael J. Striker

[57] ABSTRACT

A device for driving-in stitches, has a magazine for receiving stitches of different widths and having a housing for accommodating stitches, a slider insertable in the housing and having a guiding rail for guiding stitches and a shooting passage with an opening, an end plate mounted on the casing and a stripping plate mounted on the slider and limiting the opening of the shooting passage. The stripping plate is formed as an angular piece with a first leg which limits the shooting passage and a second leg extending substantially perpendicularly to the first leg and abutting against the slider.

15 Claims, 6 Drawing Sheets

DEVICE FOR DRIVING-IN STITCHES

This is a continuation of application Ser. No. 819,095 filed Jan. 9, 1992, now abandoned.

BACKGROUND OF THE INVENTION

The present invention relates to a device for driving-in of stitches and the like.

More particularly, it relates to a device of the above mentioned general type which has a magazine for receiving especially U-shaped stitches of different widths, with a casing and a slider insertable in the casing and having a guiding rail for guiding the stitches, as well as with a shooting passage.

Devices of the above mentioned type are known in the art. Such devices are susceptible to operational disturbances due to insufficient measurement accuracy of wear of the shooting passage. Therefore it leads to easy clamping of the stitches. The devices as a result require a very high size accuracy and manufacturing precision, and only stitches of a predetermined type can be used in the same shooting passage. The German document DE-PS 3,500,279 discloses a driving-in device in which two U-shaped types of the stitches which are insignificantly different as to their rear width can be used. For small and long clamps of strong wire or for needles, this magazine is not suitable. Moreover, the device has an opening which is too short to be used in unaccessible locations.

SUMMARY OF THE INVENTION

Accordingly, it is an object of the present invention to provide a device for driving-in stitches, which avoids the disadvantages of the prior art.

More particularly, it is an object of the present invention to provide such a device which can be used in operation in a favorable fashion and universally and simultaneously provides high operational safety.

In keeping with these objects and with others which will become apparent hereinafter, one feature of the present invention resides, briefly stated, in a driving-in device which has a magazine for receiving especially U-shaped switches of different widths, provided with a casing for stitches arranged in a row and a slider insertable in the casing and having a guiding rail for guiding the stitches, as well as a shooting passage with an opening mounted by an end plate arranged on the casing and by a stripping plate arranged on a slider, wherein in accordance with the present invention the stripping plate is formed as an angular member with a first leg which limits the shooting passage and a second leg which is bent under 90° and abuts against the slider.

When the device is designed in accordance with the present invention, it avoids the disadvantages of the prior art and provides for the above mentioned highly advantageous results.

The device can be used in operation in a favorable manner and universally and simultaneously provides for high operational safety. In particular, it can be simply used for a post-driving of not-completely driven-in stitches. Moreover a precise manufacture, especially of a stitches magazine is simple and mounting-favorable. The device permits a simple filling of the magazine with stitch clamps of widths which significantly differ from one another as well as also with needles. Wide clamps are better suitable for mounting of foils, padding, materials, etc., and for furniture. Long and small clamps with thicker wires are preferable for panels, floors, profile wood, packing wood, etc.

In accordance with another feature of the present invention, the guiding rail is very small so that both stitch clamps with very differently wide recesses as well as needles can be guided.

In accordance with another advantageous feature of the present invention, the guiding rail is formed as a member which opens downwardly to the slider, especially as a plate. This permits a simple insertion of the stripping plate.

Still another feature of the present invention is that the stripping plate has a tongue which engages in the guiding rail. Also the guiding rail can have two bent legs which abut against the slider, and their free edges form guiding tabs for the casing. With this construction of the stripping plate an angle-correct receipt of the stripping plate in the slider without orientation of post working of the surfaces which limit the shooting passage is possible in the case of long openings.

Still another feature of the present invention is that the guiding rail is provided with two bent legs abutting against the slider and having free edges. The bent legs have guiding tabs extending from the free edges and provided for the housing.

In accordance with another feature of the present invention the casing of the magazine is open downwardly and the slider is displaceable for opening of the magazine relative to the casing. The magazine is formed as a so-called low-charge magazine, and therefore after its opening the contents of the magazine is visible without removing some parts which can be lost. Also, disturbances in the magazine or in the shooting passage are very easily eliminated. The closing is performed by a simple displacement without threading-in.

In accordance with a further feature of the present invention, a one-piece meander-shaped bent stitching slider is guided on the guiding rail. The one-piece bent stitch slider facilitates the manufacture and the mounting of the device.

Another feature of the present invention is that the space between the casing and the guiding rail can be narrowed for insertion of needles and small clamps in the magazine by a displaceable strip. The strip arranged at one side and displaceable outwardly facilitates the insertion for small clamps and also lateral guidance for needles and pins.

Further, a pulling spring can be mounted on the stitch slider and applies a force to the shooting passage, and on the other hand is mounted on a bracket which is connected with the slider and guided by a deviating roller mounted on the bracket as well. The arrangement of the pulling spring, in contrast to a simple spring, provides a constant pressing force applied to the stitches.

The end plate or the stripping plate has a profile which corresponds to the dimensions of different stitches and provided with several guiding grooves and several pairs of lateral guiding surfaces. The end plate or the stripping plate profiled in correspondence with the dimensions of the stitches prevents disturbances due to inclined or clamped stitches in the shooting passage. This is true especially for small clamps.

The guiding plate can be for example releasably held in an end portion of the magazine and form a case with the housing. The releasably formed end plate has the further advantage that the magazine is convenient for manufacturing and mounting and also for service.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
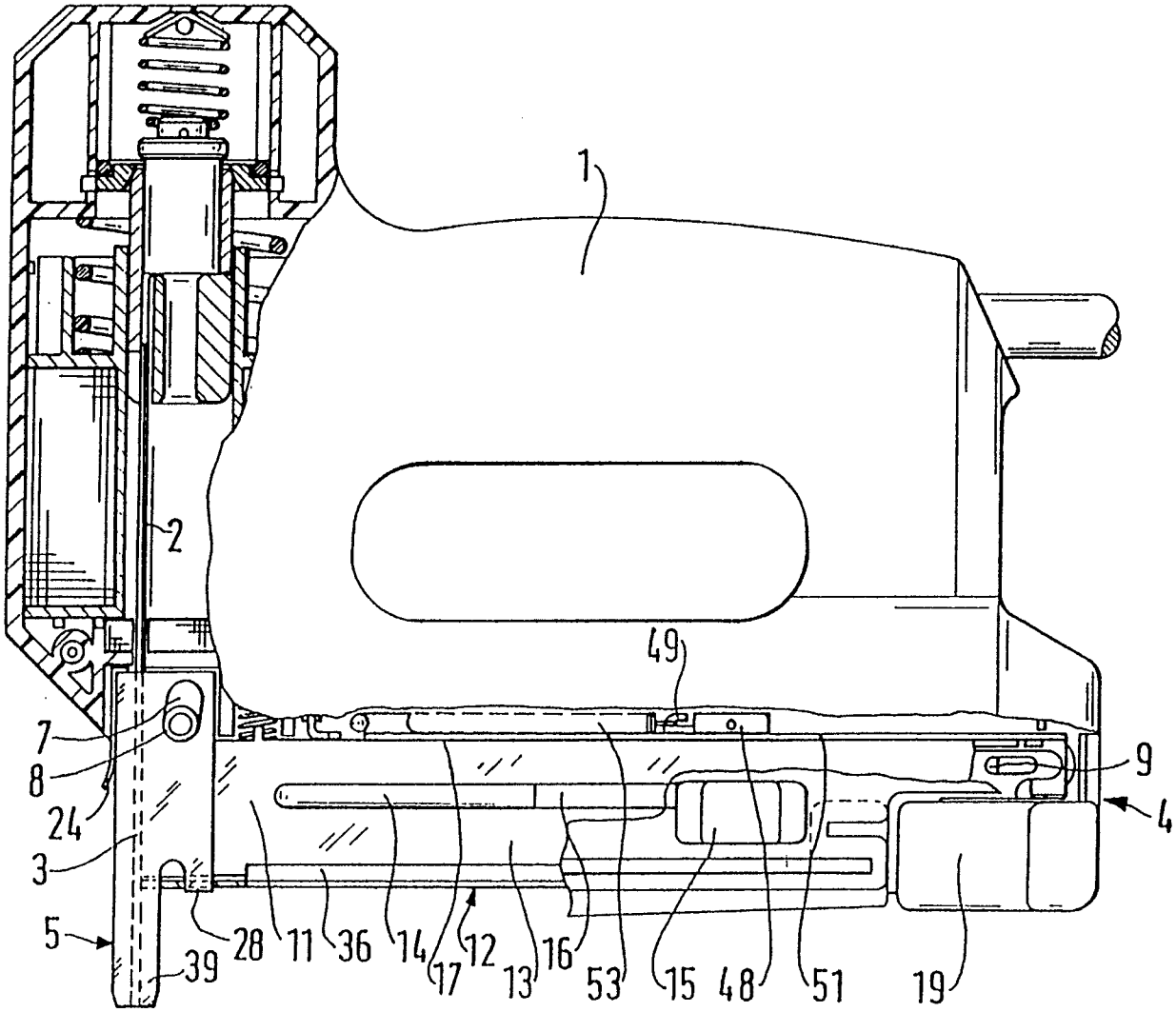
FIG. 1 is a view showing a driving-in device in accordance with the present invention with a partial section.

A driving-in device has a housing which is identified with reference numeral 1 and an input cutter 2 which is guided in a shooting passage 3 and driven by a coil through which current flows. The shooting passage 3 extends into a magazine 4 and ends in a longitudinally extending opening 5. The magazine 4 is supported in the vicinity of the shooting passage 3 in a longitudinal hole 7 in a vertically limitedly displaceable manner. A pin 8 which is fixed to the housing engages in the longitudinal hole 7. At the rear end which faces away of the shooting passage 3 the magazine 4 is connected with the housing turnably about a horizontal axle 9.

The magazine 4 includes a substantially U-shaped downwardly open casing 11 and a slider 12 engaging in the casing. The slider 12 will be described in detail with reference to FIG. 3. The casing 11 has a longitudinal slot 14 which is provided on one of its flanks 13 and is engaged by a handle 15. The handle 15 is connected inside the casing 11 with a displaceable strip 16. The strip 16 narrows the inner space of the magazine 4 in a partial region and can be formed as a metal sheet member or as a synthetic plastic-steel composite member. The upwardly located central part 17 of the casing 11 which is connected with the flanks 13 has a small slot 18. In the rear region the magazine 4 has arresting locking parts 19 for fixing the slider 12. In front the magazine is limited by a U-shaped casing end part 21 which is mounted on the flanks of the casing 11 and surrounds the shooting passage 3. The end part 21 forms a case which extends in direction of the shooting passage 3 and used for insertion of an end plate 22. Stitches 23 to be worked are guided in the end plate 22. It will be explained in detail with reference to FIG. 5.

The end plate 21 is held by a spring bracket 24 which is suspended on the end part 21, has an end engaging in a recess of the end plate 22, and is connected to the end part 21 by a holding pin 25.

Figure 2:
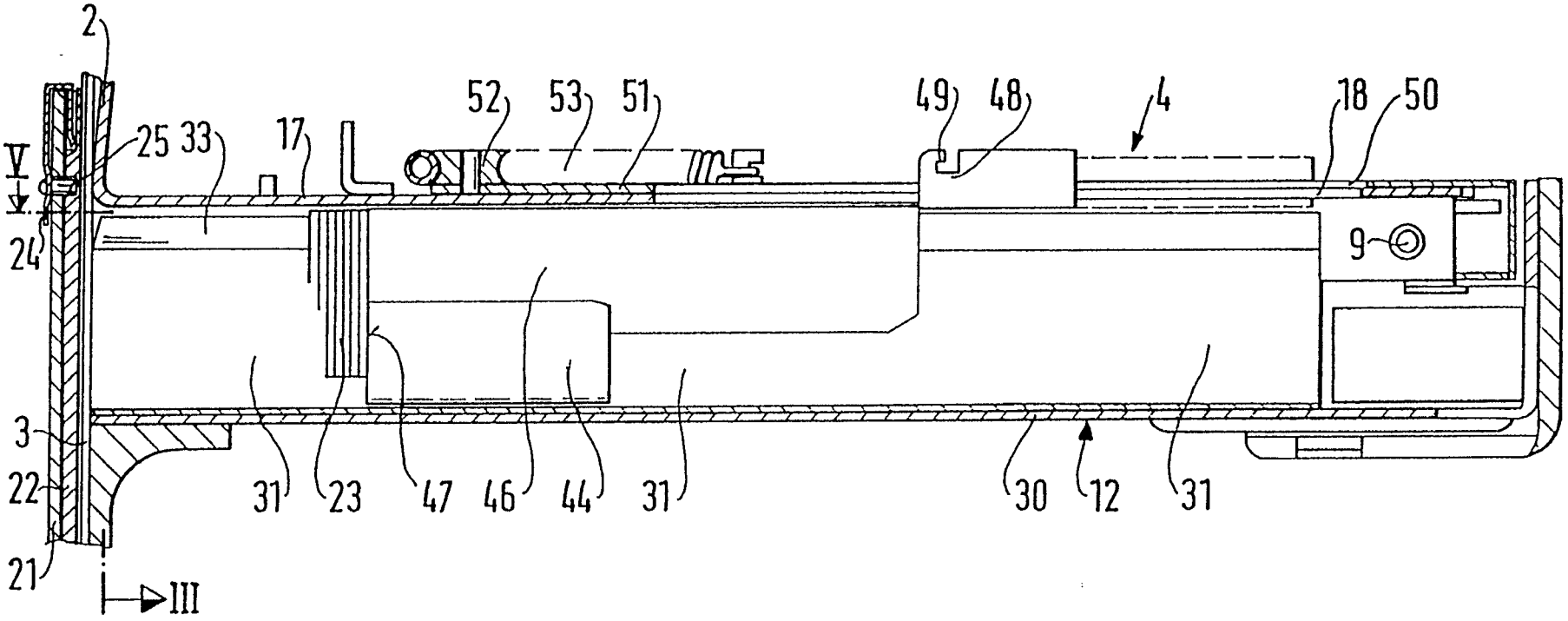
FIG. 2 is a longitudinal section through a magazine of the inventive device.

Supporting tabs 28 are bent from the end part 21 underneath the flanks 13. They engage the slider 12 and fix it in its vertical position as can be seen in FIG. 1. The slider 12 has a base plate 30 shown in FIG. 2 and mounted centrally on a one-piece guiding rail 31 for guiding the stitches 23. For example, it can be welded. The guiding rail 31 which is formed as a bent metal sheet profile is a width of approximately 4 mm, so that the stitch clamp 32 with a rear width of 4 mm can be guided on it. In the upper region the guiding rail has a depression 33, in which the heads of the needle 34 to be worked can be accommodated. The guiding rail 31 is mounted with its bent foot 35 on the base plate 30. A guiding tab 36 extends from the bent foot 35 upwardly. The guiding tab 36 guides laterally the casing 11 on its flank 13. A stripping plate 39 is received in the hollow guiding rail 31 through a slot in the base plate 30.

Figure 4:
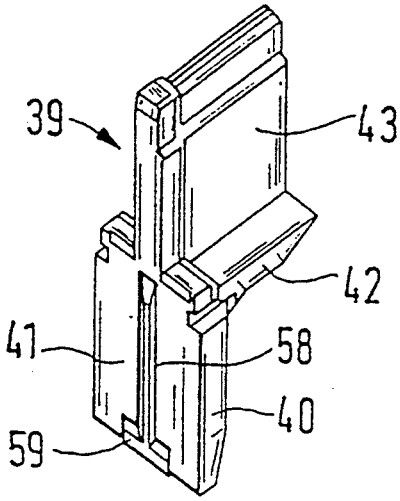
FIG. 4 is a view showing a detail of a stripping plate of the inventive device.

As can be seen from FIG. 4, the stripping plate 39 is composed of an angular member 40 which with its one leg 41 limits the opening 5 of the shooting passage 3. With its second leg which is bent by 90°, the angle member 40 abuts against the base plate 30 of the slider 12. A tongue 43 extends from the leg 42 centrally and perpendicularly in the longitudinal direction of the magazine. It engages into the open guiding rail 31 and fills it. The stripping plate 39 is fixedly connected both with the base plate 30 and with the guiding rail 31, for example by welding. Due to the solid connection of the stripping plate 39 and the slider 12 it is possible to provide a long magazine opening 5.

The stripping plate 39 together with the end plate 22 form a hardened shooting passage 3. The parts of the magazine in particular the slider 12 and the casing 21, 11 can be not hardened. Thereby significant warping problems during hardening of long sheet metal parts are avoided. With the unhardened end part 21 the spring bracket 24 serves as a hard arresting edge for the arresting spring which is mounted in the housing 1.

Figure 3:
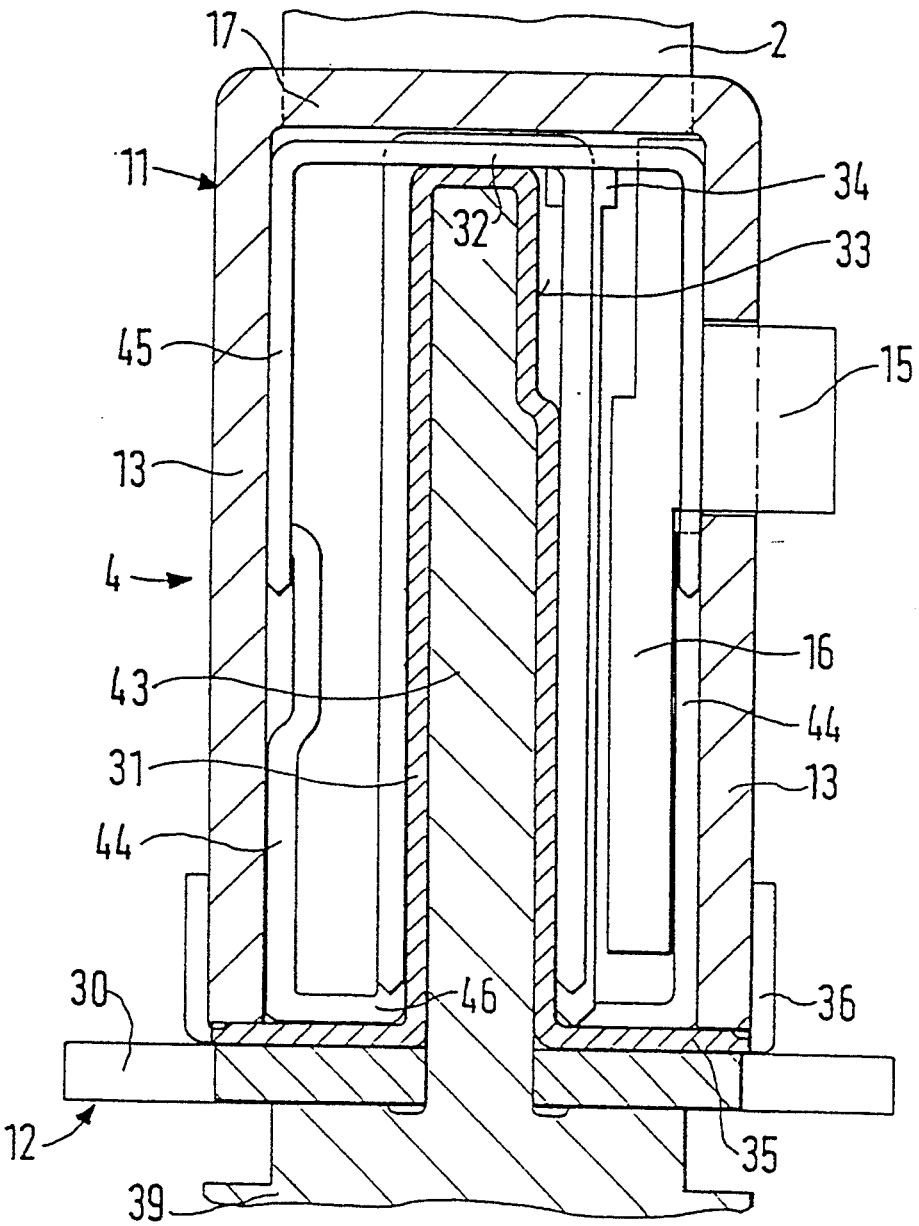
FIG. 3 is a section through the magazine, taken along the line III in FIG. 2.

FIG. 3 illustrates stitches 23 of three different types. It can be seen that in addition to the small stitching clamps 32 and the needle 34, also wide stitching clamps 45, for example 10 nun rear width can be guided in the magazine. The legs of the stitching clamps 45 abut directly against the flanks 13 of the casing 11. The strips 16 inserted between the casing 11 and the guiding rail 31 is needed as an insertion half for small clamps and for holding the needles 34. It remains during the working of wide stitch clamps in the rear position shown in FIG. 2.

A one-piece stitching slider 46 is guided on the guiding rail 31. It is composed of a sheet metal profile with a cross-section of the shape of the small stitch clamp 32. At the ends the stitch slider 46, similarly to the guiding rail 31, is bent laterally and then again upwardly for form tabs 44. Therefore an abutment surface 47 is formed on the legs of the wide stitch clamps 45 . The stitch slider 46 has a tab 48 with a shaped hook 49. The hook engages through the slot 18 and extends upwardly from the guiding rail 31. With the empty magazine the tab 48 of the stitch slider 46 comes to abutment against the front edge of the slot 18 arranged in the magazine casing 11. Thereby the stitch slider 46 cannot engage in the shooting passage and to damage it by the impact cutter 2 during an idle impact. The tab 48 is mounted at the rear end of the very long stitch slider 46. Thereby the slot 18 with the open magazine lies outside the filling space. In other words, it is avoided that the stitches (individual clamps, needles or pins) can fall into the space between the casing 11 and the housing bottom. The tab 48 extends through the slot 18 of the casing 11 as well as a slot 50 on a bracket 51 connected with the slider 12. The bracket 51 is releasably connected with the slider 12 for mounting and demounting purposes.

The bracket 51 carries a deviating roller 52 at its front end which faces the shooting passage 3 and also a hook in its central region. A pulling string 53 is suspended in both hooks on the stitch slider 46 and the bracket 51 and wound around the deviating roller 52. It therefore applies a pull to the stitch slider 46 in direction to the shooting passage 3. Thereby the stitches 23 are displaced into the shooting passage.

During opening of the magazine 4 the bracket 51 takes along the stitch slider 46, so that the filling opening is freely accessible for insertion of the stitches.

Figure 5:
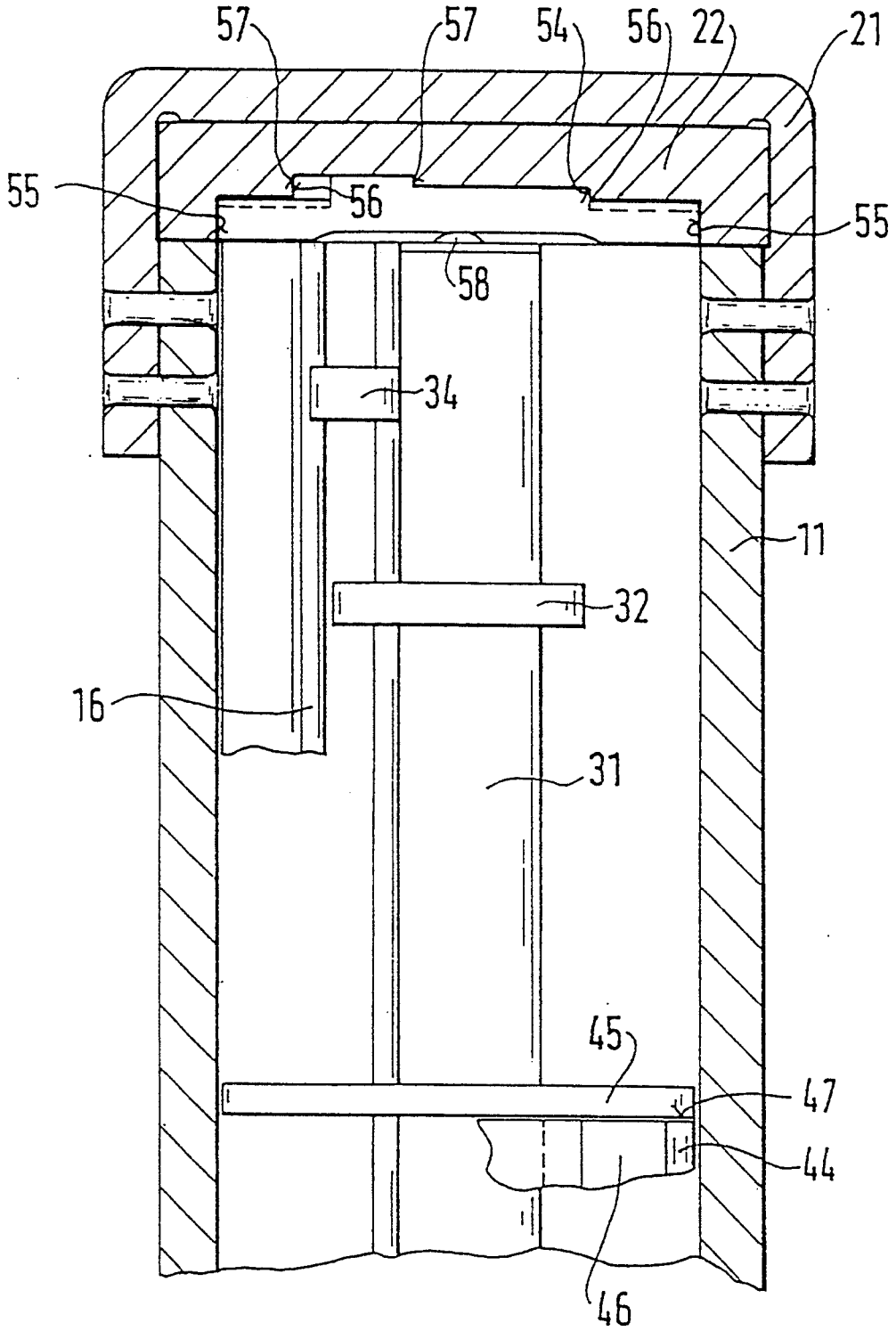
FIG. 5 is a view showing a cross-section taken along the line V in FIG. 2.
Figure 6:
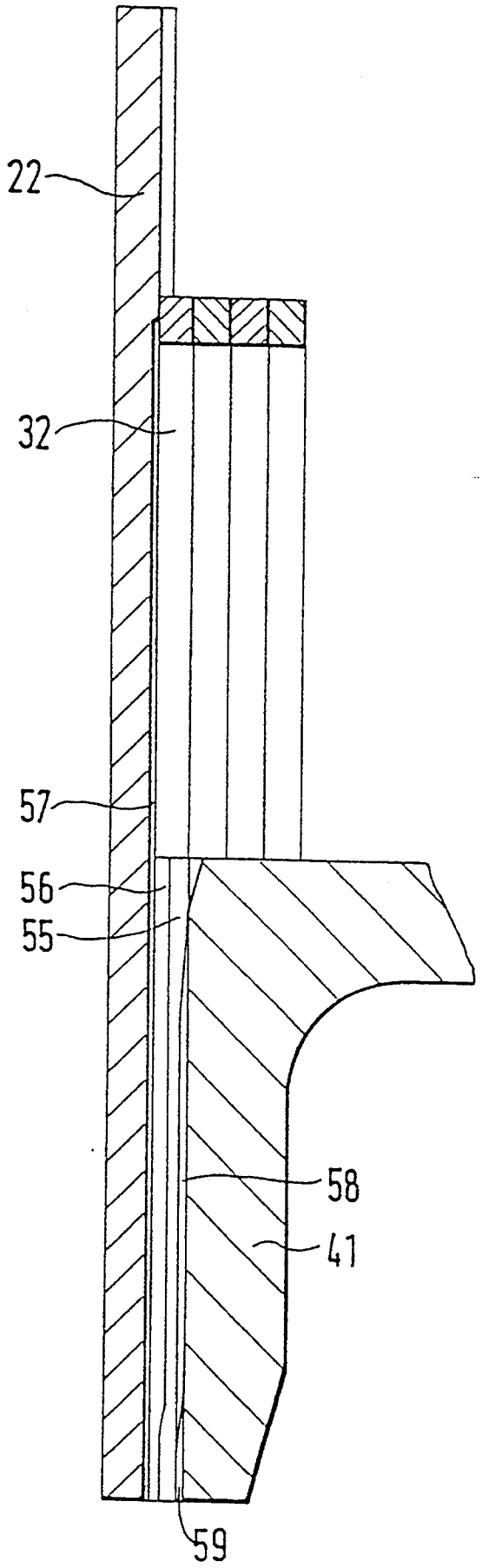
FIG. 6 s a view showing a longitudinal section through a shooting passage of the inventive device.
Figure 7:
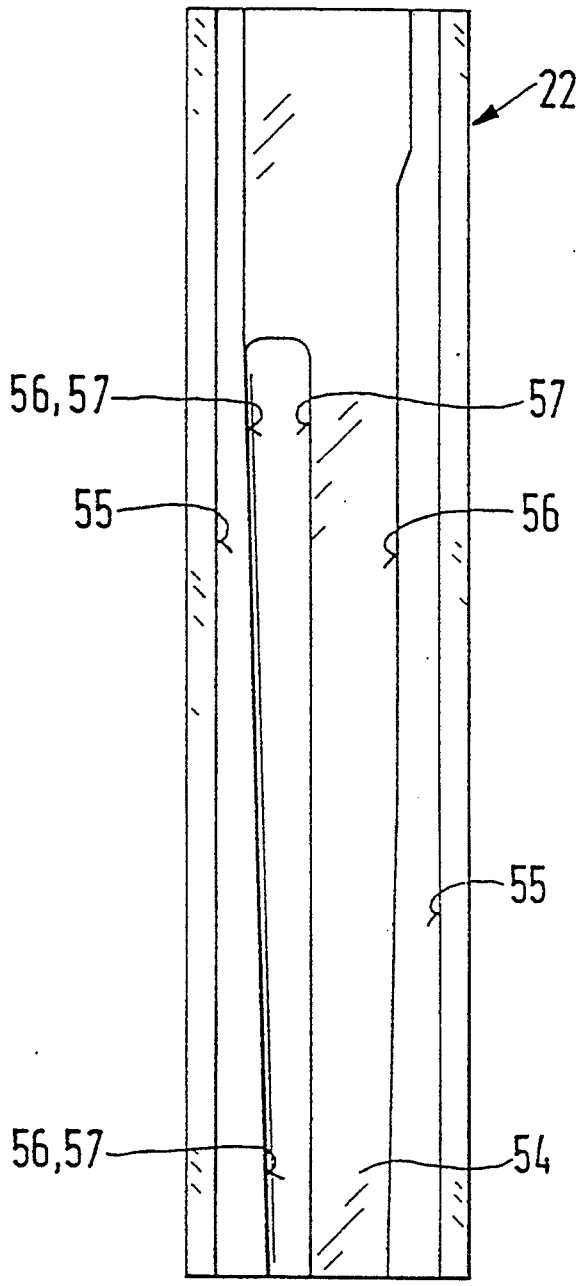
FIG. 7 is a view showing an end plate of the inventive device.

In the region in which the stitches are guided the shooting passage 3 is limited from the front by a shaped end plate 22 shown in FIG. 5. The end plate 22 is shaped so that the shooting passage 3, as considered in the longitudinal direction of the magazine is formed deeper in the central region than in the edge regions. In the edge regions the end plate 22 has a first pair of lateral guiding surfaces 55. The legs of the wide stitch clamps 45 are guided over their total leg width on the guiding surface 55. The legs of the small stitch clamps 32 are wider than the stitch clamps 45 with wide rear. The end plate 22 has a rearwardly offset second pair of guiding surfaces 56 which limit the sliding groove 54. At least a part of the width of the legs of the smaller clamps 32 abut against the guiding surfaces 56. For guiding the needles 34 a third pair of guiding surfaces 57 is provided. They guide the part of the head of the needle 34 which overlaps the width of the small stitch clamps. Three steps or two steps on one side are formed in the end plate 22. At this side of the guiding surface 56 they merge without a step into the guiding surfaces 57. In this manner all stitches 23 to be worked are laterally guided in a single end plate 22.

For improving the lateral guiding conditions of the small clamps 32, the guiding groove 54 which is limited by both guided surfaces 56 is deeper than the depth which would require for the wire thickness of the clamps 32. For retaining the clamps 32 in the preliminarily displaced position during the driving-in movement in the shooting passage 3, the leg 41 is provided with a small guiding rib 58 having a height which exactly corresponds to the depth of the guiding passage. The guiding rib 58 is designed so that it deforms the rear of the wide clamps 45 as little as possible and does not damage them. For this reason the guiding rib 58 is small and provided with a widening 59 only at the end of the opening 5. In the region of the widening 59 the guiding surfaces 55 are also widened for the wider clamps 45. Therefore the wide clamps on the last millimeters of the driving movement can be guided without bending of the rear part.

The construction of the edges of the guiding surfaces 56 and 57 is decisive for the driving outcome of small clamps 32 and needles 34 and the standing time of the shaped end plate 22. The edges must be as sharp as possible. Since this can be achieved with conventional manufacturing processes only with inexpensive manner, the sintered parts are tested with good results. With this process the guiding surfaces 56 and 57 must not extend parallel, they can be for example funnel shaped. The sintered material can be impregnated with oil to contribute to a further wear reduction.

The filling of the driving-in device with stitches is very simple. The device is held with its opening 5 upwardly and the slider 12 is pulled rearwardly from the shooting passage 3 in the longitudinal direction of the magazine. The stitch slider 46 is withdrawn on its tab 48 from the front flank of the slot 50 arranged in the bracket 51. Thereby the full cross-section of the casing 11 is accessible. The wide stitch clamps 45 are simply inserted with the rears downwardly and the slider 12 is again closed. For insertion of small stitch clamps 32 and the needle 34, the strip 16 is displaced in the handle 15 forwardly in direction of the shooting passage 3 and then the stitches are placed on it. After this the slider 12 can be closed without problems. The guiding rail 31 displaces in the stitch pack, so that the clamps 32 ride on it. During insertion of the needles they are held in the closed magazine by the strip 16 and one side flank and the depression 33 of the guiding rail 31.

During driving in of a wide clamp 45, its rear is bent in the region of the guiding rib 58 substantially in direction to the end plate 22. This however does not affect the operational safety of the device. It provides however the advantage for the small clamps 32 in improved lateral guidance over the greater part of the extension of the shooting passage. Only over the last millimeters, or only a fraction of the leg length, the guiding surfaces 36 are formed small. The extension is however so short that a lateral bending of the clamp leg is not possible there.

It will be understood that each of the elements described above, or two or more together, may also find a useful application in other types of constructions differing from the types described above.

While the invention has been illustrated and described as embodied in a driving-in device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for driving-in stitches, comprising a magazine for receiving stitches of different widths and having a casing for accommodating stitches; a slider insertable in the casing and having a guiding rail for guiding stitches, and a shooting passage with an opening; an end plate mounted on said casing and a stripping plate mounted on said slider, said end plate and said striping plate limiting said opening of said shooting passage, said stripping plate being formed as an angular piece with a first leg which limits said shooting passage and a second leg extending substantially perpendicularly to the first leg and abutting against the slider, said guiding rail being fixedly connected with said slider so that sad magazine is opened when said slider together with said guiding rail is withdrawn from said shooting passage, said guiding rail being hollow, said stripping plate having a tongue which extends in an interior of said guiding rail.

2. A device as defined in claim 1, wherein said guiding rail is a one-piece member mounted on said slider.

3. A device as defined in claim 1, wherein said guiding rail has a size such that stitch clamps, and also needles can be guided by it.

4. A device as defined in claim 1, wherein said guiding rail is formed as a member which opens downwardly toward said slider.

5. A device as defined in claim 4, wherein said guiding rail is formed as a metal sheet member.

6. A device as defined in claim 1, wherein said guiding rail has two bent legs abutting against said slider and having free edges, said bent legs having guiding tabs extending from said free edges.

7. A device as defined in claim 1, wherein said casing of said magazine is downwardly open, said slider being displaceable relative to said casing for opening said magazine.

8. A device as defined in claim 1, wherein at least one of said end plate and stripping plate has a shape which corresponds to dimensions of different stitches and is provided with several guiding grooves and several pairs of lateral guiding surfaces.

9. A device as defined in claim 8, wherein both said end plate and stripping plate has a shape which corresponds to dimensions of different stitches and is provided with several guiding grooves and several pairs of lateral guiding surfaces.

10. A device as defined in claim 1, wherein said magazine has a casing end part which forms a case, said end plate being held in said casing end part of said magazine.

11. A device as defined in claim 10, wherein said end plate is releasably held end of said magazine.

12. A device for driving-in stitches, comprising a magazine for receiving stitches of different widths and having a casing for accommodating stitches; a slider insertable in the casing and having a guiding rail for guiding stitches, and a shooting passage with an opening; an end plate mounted on said casing and a stripping plate mounted on said slider, said end plate and said striping plate limiting said opening of said shooting passage, said stripping plate being formed as an angular piece with a first leg which limits said shooting passage and a second leg extending substantially perpendicularly to the first leg and abutting against the slider, said guiding rail being fixedly connected with said slider so that said magazine is opened when said slider together with said guiding rail is withdrawn from said shooting passage; a stitch slider guided on said guiding rail; and a pulling spring which is mounted on said stitch slider and applies a force to said stitch slider in direction toward said shooting passage, said guiding rail being hollow, said stripping plate having a tongue which extends in an interior of said guiding rail.

13. A device as defined in claim 12; and further comprising a bracket connected with said stitch slider and a deviating roller mounted on said bracket, said pulling spring being mounted on said bracket and guided over said deviating roller.

14. A device for driving-in stitches, comprising a magazine for receiving stitches of different widths and having a casing for accommodating stitches; a slider insertable in the casing and having a guiding rail for guiding stitches, and a shooting passage with an opening; an end plate mounted on said casing and a stripping plate mounted on said slider, said end plate and said stripping plate limiting said opening of said shooting passage, said stripping plate being formed as an angular piece with a first leg which limits said shooting passage and a second leg extending substantially perpendicularly to the first leg and abutting against the slider, said guiding rail being fixedly connected with said slider so that said magazine is opened when said slider together with said guiding rail is withdrawn from said shooting passage, said guiding rail being hollow, said stripping plate having a tongue which extends in an interior of said guiding rail, at least one of said end plate and stripping plate has a shape which corresponds to dimensions of different stitches and is provided with several guiding grooves and several pairs of lateral guiding surfaces, said guiding grooves including guiding grooves for smaller clamps; and a central guiding rib provided on said first leg of said angular piece which limits said shooting passage.

15. A device for driving-in stitches, comprising a magazine for receiving stitches of different widths and having a casing for accommodating stitches; a slider insertable in the casing and having a guiding rail for guiding stitches, and a shooting passage with an opening; an end plate mounted on said casing and a stripping plate mounted on said slider, said end plate and said stripping plate limiting said opening of said shooting passage, said stripping plate being formed as an angular piece with a first leg which limits said shooting passage and a second leg extending substantially perpendicularly to the first leg and abutting against the slider, said guiding rail being fixedly connected with said slider so that said magazine is opened when said slider together with said guiding rail is withdrawn from said shooting passage, said guiding rail being hollow, said stripping plate having a tongue which extends in an interior of said guiding rail, said end plate having a recess; and a springy holding element engageable in said recess.

* * * * *